US005997262A

United States Patent [19]

Finkbeiner et al.

[11] Patent Number: 5,997,262

[45] Date of Patent: Dec. 7, 1999

[54] SCREW PINS FOR A GEAR ROTOR FUEL PUMP ASSEMBLY

[75] Inventors: Steven P. Finkbeiner; Kirk D. Fournier, both of Essexville; George E. Maroney, Kingston; Glenn A. Moss, Cass City, all of Mich.

[73] Assignee: Walbro Corporation, Cass City, Mich.

[21] Appl. No.: 08/833,931

[22] Filed: Apr. 10, 1997

[51] Int. Cl.[6] ..... F04B 17/00

[52] U.S. Cl. ..... 417/410.4; 418/171; 418/166

[58] Field of Search ..... 417/410.4; 418/166, 418/171

[56] References Cited

U.S. PATENT DOCUMENTS

| | | | |
|---|---|---|---|
| 2,531,808 | 11/1950 | Eames . | |
| 2,966,118 | 12/1960 | McAlvay . | |
| 3,106,897 | 10/1963 | Johnson . | |
| 3,244,111 | 4/1966 | Shelhart . | |
| 3,272,130 | 9/1966 | Mosbacher . | |
| 4,352,641 | 10/1982 | Tuckey . | |
| 4,398,874 | 8/1983 | Eisenmann . | |
| 4,401,416 | 8/1983 | Tuckey . | |
| 4,500,270 | 2/1985 | Tuckey | 418/133 |
| 4,526,518 | 7/1985 | Wiernicki . | |
| 4,596,519 | 6/1986 | Tuckey . | |
| 4,697,995 | 10/1987 | Tuckey . | |
| 4,820,138 | 4/1989 | Bollinger . | |
| 4,958,997 | 9/1990 | Harwath . | |
| 4,978,282 | 12/1990 | Fu et al. . | |
| 5,122,039 | 6/1992 | Tuckey . | |
| 5,156,540 | 10/1992 | Fernau et al. . | |
| 5,248,223 | 9/1993 | Hill . | |
| 5,340,293 | 8/1994 | Yasuda et al. . | |
| 5,411,376 | 5/1995 | Fournier et al. . | |
| 5,472,329 | 12/1995 | Maynard et al. . | |

*Primary Examiner*—Timothy S. Thorpe
*Assistant Examiner*—Cheryl J. Tyler
*Attorney, Agent, or Firm*—Reising, Ethington, Barnes, Kisselle, Learman & McCulloch, P.C.

[57] ABSTRACT

An in-tank type electric motor fuel pump with a fuel inlet end cap, a fuel outlet cap, a case coaxially joining the end caps to form a pump housing, an electric motor mounted in the housing having a stator with spring-retained permanent field magnets surrounding the motor armature, and a gerotor pump in the housing rotatably driven by the motor armature. An inlet port plate, an outlet port plate and a cam ring sandwiched between the plates form a gerotor pocket axially between the plates, and inner and outer gear rotors are disposed in the pocket with intermeshing teeth defining circumferentially disposed expanding and ensmalling pumping chambers. A pair of alignment and fastening screw pins are the sole hardware for clamping the plates and cam ring in tightly sandwiched relationship and holding the pump unit together in properly axially, radially and angularly oriented component relationship in precision final assembly as an operable gerotor pump. The screw pins each have a cylindrical smooth surface shank portion precision fitting in smooth wall precision aligned bores in the plates and cam ring. The screw pin threaded end threadably engages a threaded portion of the inlet plate bore hole that is slightly reduced in diameter relative to the smooth surface bore holes. The radial tolerances between the pin and inlet plate hole threads are larger than that between the pin shank smooth portion and the associated smooth surface alignment bores in the plates and cam ring to prevent alignment distortion from thread seating stresses. The screw pins also have axially elongated and slotted screw heads that serve as fail-safe stops limiting loosening motion of the magnets. The pump rotors have predetermined fixed assembly axial and radial clearance dimensions relative to the pump plates and cam ring respectively established and maintained in assembly by the screw pins fitment in the plates and cam ring.

17 Claims, 4 Drawing Sheets

SCREW PINS FOR A GEAR ROTOR FUEL PUMP ASSEMBLY

FIELD OF THE INVENTION

The present invention relates to fuel pumps for internal combustion engines and more particularly to an electric motor driven, gear rotor or gerotor-type positive displacement pump assembly of unitary and simplified construction capable of delivering liquid fuel at relatively high output pressures resistant to contaminant-induced wear.

BACKGROUND OF THE INVENTION

Electrically driven, self-contained in-tank gear rotor or gerotor fuel pumps have been used extensively for delivering fuel from a supply tank to an internal combustion engine of a motor vehicle or water craft. This type of pump produces a steady, non-surging, relatively highly pressurized flow of fuel over a relatively wide speed range, making it ideal for use with modern fuel injection systems. The design is also highly tolerant of fuel supply line pressure transients commonly associated with the abrupt opening and closing of individual fuel injectors.

Typically these pumps consist of a housing having a direct current electric motor with stationary, field-generating permanent magnets retained in place against a cylindrical flux tube by spring clips mounted in the housing, and a wound armature journalled for rotation in the housing and coupled to a gerotor pump assembly. Examples of various types of improvements in such pump constructions are shown in U.S. Pat. Nos. 4,352,641; 4,401,416; 4,500,270; 4,596,519; 4,697,995; 5,122,039; 5,248,223 and 5,411,376 all assigned to the assignee of record herein, Walbro Corporation of Cass City, Mich., and incorporated herein by reference. Although the gerotor fuel pumps disclosed in most of the above noted patents have enjoyed substantial commercial acceptance and success, improvements remain desirable. One problem lies in the difficulty and the complexity of fastening and aligning the inlet end cap, cam ring, outlet port plate and gerotor components during assembly of the pump. In gerotor pumps of the fixed face clearance (FFC) type these components must be precision machined to precise axial and radial dimensions to establish appropriate tolerance limits for the desired axial and radial clearances between the moving and stationary parts of the pump in order to optimize pump performance and efficiency. The parts must be securely and accurately axially clamped together in assembly and also accurately angularly aligned for proper registry of the inlet and outlet ports with the angular operational orientation of the inner and outer rotors of the gerotor pump. Typically, when it is desired to provide the pump as a unitary, operative subassembly, the clamping together of the pump components in assembly is accomplished by mounting bolts or cap machine screws threaded through corresponding aligned threaded holes in the inlet cover plate or cap, gerotor cam ring and outlet port plate. Two, three or even four of fastening such screws are typically provided, as well illustrated in U.S. Pat. No. 4,978,282. However, because it has not been economically feasible to achieve precision angular inter-alignment by using such threaded clamping screws or fasteners and associated threaded mounting holes, it is also customary to provide one or more precision formed and ground unthreaded alignment pins and precision finished unthreaded alignment bores in one or both of the end plates and cam ring to thereby establish accurate angular orientation of the pump components during assembly. The provision of both such sets of fastener screws and alignment pins, of course, adds cost to the pump assembly in both the manufacture and assembly of these pump components.

Another type of gerotor pump disclosed in several of the above noted patents is of the "zero clearance" type is which the gerotor components and associated cam ring are resiliently biased against one of the pump end plates by various forms of spring constructions including spring-type valve plates. Although such zero clearance type pumps are highly efficient from the manufacturing and performance stand point, if operated with contaminant-laden fuel, particularly "dry-fuel" of low lubricity, and driven to develop output pressures exceeding their normal ratings, such pumps can suffer undue wear and loss of efficiency and hence reduction in acceptable performance and operational life. Such adverse operational conditions can be encountered, for example, in certain marine engine applications often requiring fuel system delivery pressures in the order of 90 psi versus the typical 30–60 psi pump output pressures required of standard fuel pumps for use with automotive fuel injection systems FFC type gerotor pumps can more readily achieve such higher output pressures, but undue wear remains a problem, albeit less so, even with this type of pump under such adverse conditions.

Another problem encountered with in-tank fuel pumps under adverse shock and vibration conditions is the loosening of the motor field permanent magnets from their spring finger retention, as when so mounted in the pump housing or casing as shown in the above noted U.S. Pat. Nos. 4,352,641 and 5,000,270. Typically a special stop protuberance configuration is provided in the material of the pump inlet end cap or cam ring construction to serve as a fail-safe catch stop in the event of such loosening of the magnets so that the same can not be shaken to slip axially toward the pump structure and thus out of proper field alignment with the armature windings of the motor rotor. However, providing such geometry to the pump casing or pump inlet end cap construction or cam ring is not feasible in some applications, and in any event adds cost and weight to this pump part.

OBJECTS OF THE INVENTION

Accordingly, objects of the present invention are to provide an improved fixed face clearance (FFC) type gerotor pump, and improved method of making for use in an electric motor fuel pump of the aforementioned assembly character having an improved fastening and angular alignment hardware construction of reduced cost and complexity in both components and assembly and to provide an economical fail-safe stop feature for preventing axial displacement of the spring-fastened motor magnets from their initially installed location.

Another object is to provide an improved in-tank fuel pump utilizing an FFC type gerotor pump assembly and motor construction of the above-character and co-operable with a fuel inlet filter for the electric fuel pump to provide a contaminant resistant positive displacement pump capable of operating at higher output pressures and less susceptible to adverse wear influences of low lubricity and particle contaminants in the fuel to thereby achieve an improved operational life at greater output pressures while still providing acceptable overall pump efficiency and performance.

SUMMARY OF THE INVENTION

In general, and by way of summary description and not by way of limitation, the invention achieves the foregoing objects by providing an electric fuel pump having a housing containing an electric drive motor of the wound armature, stationary permanent field magnet type mounted therein with the armature coupled to rotationally drive the inner rotor of the gerotor pump that is also mounted in the housing. The gerotor pump is made as a unitary subassembly comprising a ported inlet cap and a ported outlet plate with a conventional cam ring and inner and outer rotors of the gerotor sandwiched therebetween. These pump components are clamped axially together and held in assembly as well as being accurately angularly oriented in a precision manner, by employing only two specially formed locator screws and cooperative specially formed screw mounting openings in the cam ring and plates.

More particularly, the associated mounting through-holes in the port plate (upper end cap), cam ring and lower inlet cap, the inner rotor guide pin and its journal mounting hole in the inner ("star") gerotor, and its press fit hole in the inlet cap, are all made to precision tolerances. Each of the two locator and fastener screws has a smooth cylindrical shank made with a precision diametrical dimension so that the locator screw serves as an alignment and angular orintation pin to accurately set the eccentric relationship of these gerotor pump parts and angular registry of the pump ports in assembly and with reference to the stationary center pin on which the inner gerotor or star rotates. Each locator screw also has a large diameter screw head that cooperates with a reduced diameter lower end that is externally threaded so that the locator screw also serves a threaded fastener for the sandwiched pump parts by threadably meshing with internal threads specially formed at the lower end of the two through-holes in the inlet cap. These internal and external threads have a loose tolerance interengagement so that tightening of the locator screws will not affect or alter the guide pin alignment function of the smooth shank of the locator screws. This results in a reduced number of pump components (elimination of two separate orientor pins) and elimination of the need for final shifting adjustment of the cam ring during pump assembly. As an ancillary feature, axially elongated screw heads are provided one on each locator screw so that also serve as fail-safe stops for the two motor permanent magnet segments (which are in axial alignment with the screw heads) should the magnets be shaken loose from their spring retaining clips in the motor assembly during operation and use of the fuel pump.

The axial dimensions of the inner external tooth star and outer internal tooth ring of these gerotor parts are made slightly less then the axial spacing of the opposite faces of the gerotor cam ring in order to set up a predetermined and relatively large fixed face or axial clearance between these rotary gerotor parts and their stationary flanking outlet port plate and inlet port cover or cap plate. Hence, these gerotor parts can float axially during their rotation between these two boundary plates within this fixed axial clearance. Preferably this axial clearance is in the order of 0.0005"–0.0030" total face clearance, (i.e., 0.00025"–0.0015" nominal axial clearance per side). In addition, the cylindrical O.D. radial clearance between gerotor outer ring and the cam ring is in the range of 0.0015 to 0.0050 inches.

Due to such radial and axial internal pump part clearances there is a potential internal short circuit or leakage path from the high pressure to low pressure side of the pump parts internally thereof which produces a thin film of the liquid being pumped to thereby provide a hydro-dynamic anti-friction liquid bearing between these relatively moving parts. However, the thickness of this liquid auto-function bearing film axially of the pump is small enough so that it effectively serves as a liquid seal to limit such short circuiting liquid flow internally of the pump to only a small percentage of pump output flow rate.

The hydro-dynamic anti-friction liquid bearing thereby obtained during pump operation thus prevents direct contact and wear of the outer gerotor against the inner surface of the cam ring despite the high pressure side (radial) thrust forces encountered during normal operation of a gerotor pump. The liquid seal barrier also prevents excessive wear from minute contaminant particles entrained in the fuel circulating through the pump. Even with uncontaminated fuel frictional drag is also reduced as compared to zero clearance gerotor pumps having relatively moving pump part surfaces in direct sliding contact. End face wear and end force frictional drag of the inner and outer gerotors relative to the axially flanking faces of the outlet port plate and inlet cap plate thus is also reduced or eliminated.

Due to these features the pump can operate at higher output pressure, e.g., 90 psi versus 30–60 psi normally encountered in most automotive applications, while also pumping "dry gasoline" (i.e., gasoline such as winter fuel having very low lubricity) and/or containing a high degree or particulate contamination without experiencing the excessive wear produced in a zero clearance type gerotor pump under such conditions. As a consequence the pump of the invention provides improved boundary lubrication, reduced drag and reduced contamination sensitivity, resulting in increased pump efficiency, reliability and service life.

BRIEF DESCRIPTION OF THE DRAWINGS

The present invention, together with additional objects, features and advantages thereof will become further apparent from the following detailed description of a preferred but exemplary embodiment of the best mode of making and using the invention, from the appended claims and the accompany drawings (which are to engineering scale unless otherwise indicated) in which:

DETAILED DESCRIPTION OF THE PREFERRED EMBODIMENT

Figure 1:
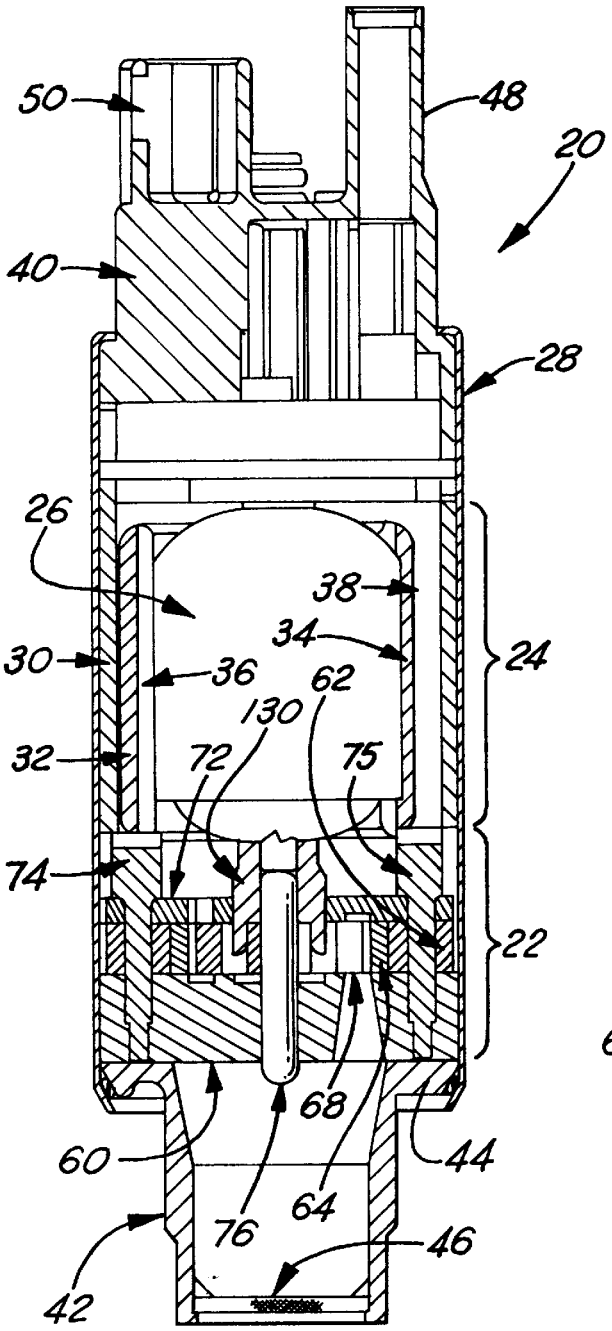
FIG. 1 is a longitudinal center sectional view, somewhat simplified, of a self-contained electric-motor fuel pump constructed in accordance with a presently preferred embodiment of the invention.

FIG. 1 illustrates an electrically driven, self-contained in-tank gear rotor type (or gerotor type) fuel pump 20 of unitary construction in accordance with the invention for delivering fuel under high pressure from a supply tank (not shown) in which it is submerged to the fuel delivery system of an internal combustion engine of a motor vehicle, water craft or the like (also not shown). Fuel pump 20 has a gear rotor pump assembly 22 and a conventional direct current electric motor 24 with a wound armature 26 journalled for rotation within an encapsulating housing 28. The stator of motor 24 comprises a flux ring 30 mounted in fixed relation to housing 28 and surrounding a pair of arcuate permanent magnets 32 and 34 retained by spring fingers 36 and 38, as in the manner shown in more detail the above noted U.S. Pat. No. 4,352,641 incorporated herein by reference and hence not described in detail. See also in this regard the above noted U.S. Pat. No. 4,697,995, also incorporated herein by reference.

As also shown in FIG. 1, pump 20 has an outlet end cap 40 secured to and protruding from the upper end of housing 28 in a conventional manner and has a hollow inlet end cap 42 with a flange 44 secured and sealed within the lower end of housing 28 also in a conventional manner. Gerotor pump assembly 22 is secured as a unitary subassembly by the encircling housing 28 and axially clamped between the motor stator components and flange 44 of the lower end cap 42. A conventional fuel filter 46 is mounted within the lower inlet opening of inlet cap 42 for preventing particulate matter from entering and damaging pump assembly 22. Outlet end cap 40 is of unitary construction having an outlet nipple 48 extending upwardly and outwardly therefrom which is communication with the interior of pump housing 28 to enable passage of fuel expelled from the pump assembly 22 out of the pump 20. To supply electrical power to the motor armature 26, the outlet end cap 40 has a conventional sealed electrical terminal construction at 50.

Figure 2:
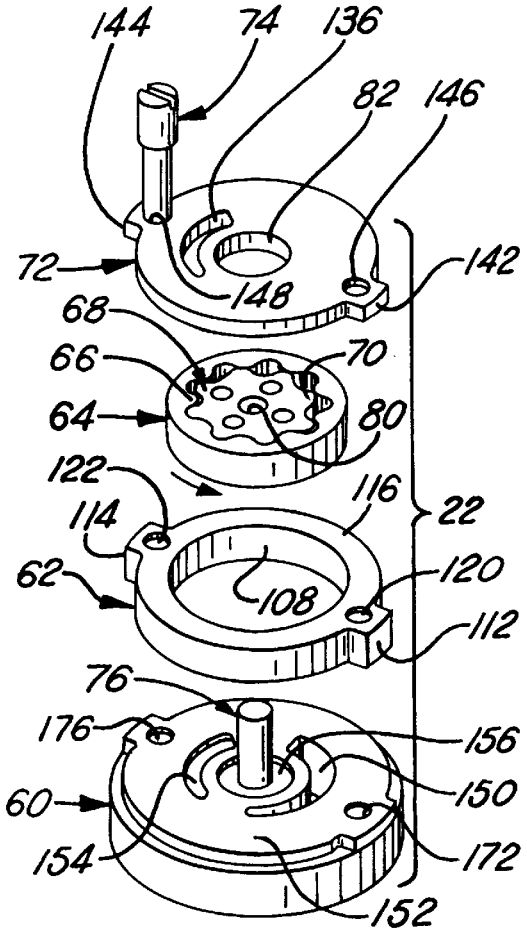
FIG. 2 is an exploded perspective view of the inlet port cap or cover plate, gerotor cam ring, gerotor rotors, outlet port plate and one of the two locator screws of the gerotor pump assembly employed in the fuel pump of FIG. 1.
Figure 3:
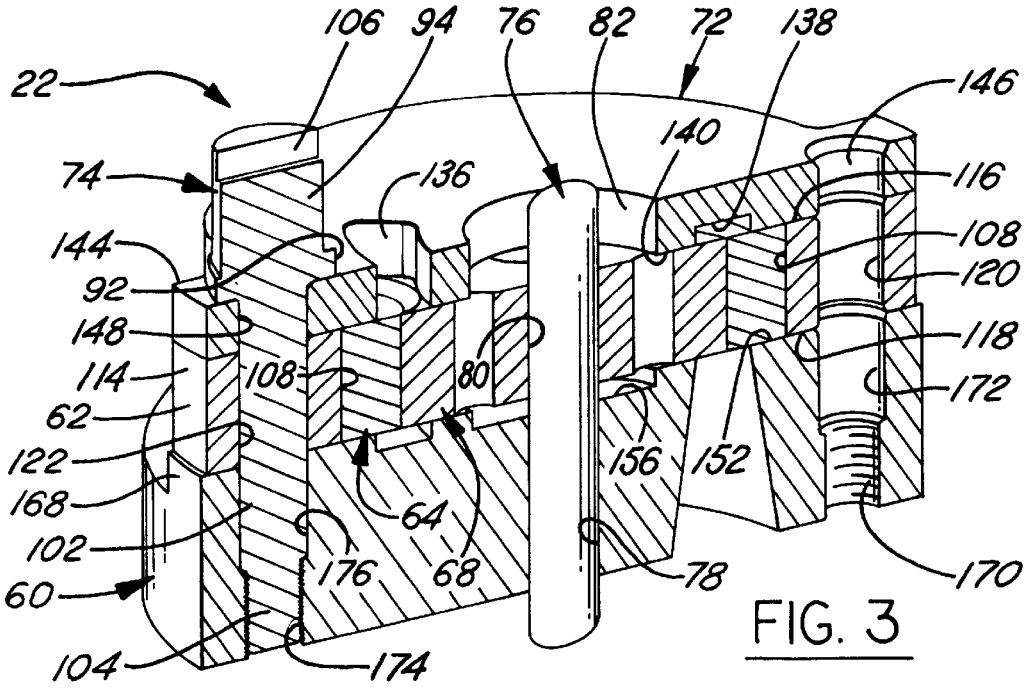
FIG. 3 is a perspective half sectional view of the gerotor pump components shown assembled but separate from the fuel pump of FIG. 1.
Figure 4:
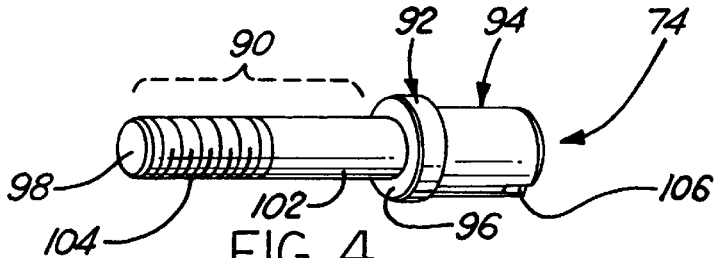
FIGS. 4, 5, 6 and 7 are respectively a perspective view, lower end view, horizontal elevation and upper end view of one of the two locator screws utilized in the gerotor pump construction of FIGS. 1–3.
Figure 5:
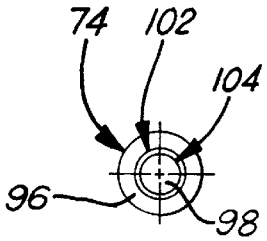
Figure 6:
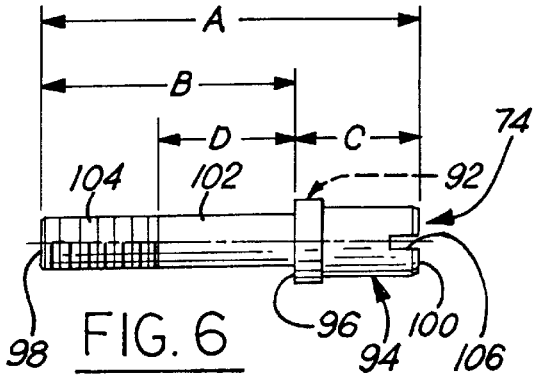
Figure 7:
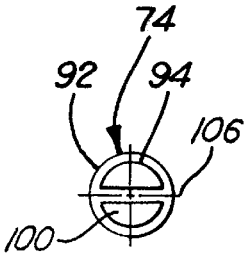
Figure 8:
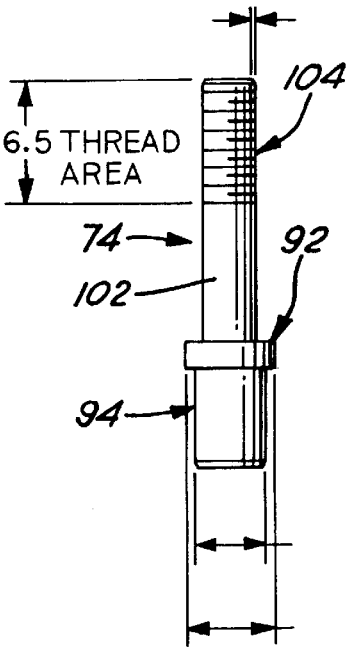
FIG. 8 is a vertical side elevational view of the locator screw of FIGS. 4–7 rotated in 90° from its showing in FIG. 6.

Referring more particularly to FIGS. 2 and 3, gear rotor pump assembly 22 is made up of an inlet plate 60, a cam ring 62, a gerotor subassembly made up of outer ring rotor 64 with nine internal teeth 66 and an inner star rotor 68 with eight external teeth 70, an outlet port plate 72 and a pair of identical combined locator pin and fastener cap screws 74 and 75 (only screw 74 being shown in FIGS. 2 and 3). Pump assembly 22 also has a cylindrical stub shaft 76 precision made and press fit into an axial center throughbore 78 precision machined in inlet plate 60. The upper end of stub shaft 76 protrudes upwardly with a precision close clearance fit through a central axial throughbore 80 of inner rotor 68 to journal the same for rotation on stub shaft 76, and then extends further upwardly through a relatively large opening 82 in outlet plate 72 so as to terminate a given distance thereabove.

In accordance with one feature of the invention pump assembly 22 is both securely held togther and all of its components precisioned aligned radially, axially and angularly as a gerotor operable subassembly by only the two combination fastener screw alignment pins 74 and 75. This is accomplished by forming a portion of each screw 74, 75 to serve as a precision alignment pin, and likewise forming the mounting holes in inlet port plate 60, cam ring 62 and outlet port plate 72 as precision machined alignment bores. The manufacturing tolerances of these elements is thus reduced accordingly over conventional practice. However normal thread tolerances are observed in forming the external male threads at the lower end of each screw pin 74, 75, and then loosened thread tolerances are provided forming the internal or female threads of a threaded socket located as an open lowermost counterbore termination of each of the pair of alignment bores in the inlet plate 60.

The details of the alignment screw pin 74 are illustrated in FIGS. 4–8, it being understood that screw pin 75 is identical to pin 74. Pin 74 comprises an elongate cylindrical shank 90, a radially enlarged cylindrical flange portion 92 and a cylindrical head 94 somewhat smaller in diameter than flange 92. The axial dimension B (FIG. 6) from a lower radial face 96 of flange 92, as formed at its junction with shank 90 to the free lower end face 98 of shank 90 is made slightly less than the total axial stack-up dimension of inlet plate 60, cam ring 62 and port plate 72. The dimension C from flange face 96 to the upper end face 100 of head 94 is also a controlled dimension correlated with the assembled position of pump assembly 22 and that of motor magnets 32 in their final assembled orientation in housing 28. As will be seen in FIG. 6 the axial dimensions B and C together total the overall axial dimension A of fastener 74.

Shank 90 is specially formed in accordance with the invention to have a cylindrical alignment pin portion 102 extending axially from flange face 96 to meet an externally threaded portion 104 which extends to end face 98. Pin portion 102 is precision machined to provide a smooth cylindrical surface of constant diameter throughout its axial dimension D (FIG. 6) at a diameter of, for example, 2.82–2.85 mm. The threaded portion 104 is provided with a standard machine screw thread of slightly smaller diameter than that of alignment pin portion 102, for example, 2.79 mm. This thread form may be, for example, #4-40 UNC-3A. Preferably, a screw driver cross slot 106 is machined in the end of screw head 94. However, other torque-application head configurations can be used, such as hex head, square head, Allen wrench socket, etc.

Figure 9:
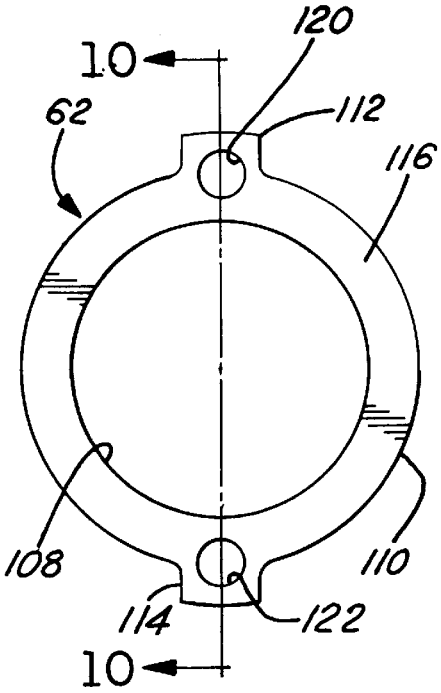
FIG. 9 is a top plan view of the cam ring of the gerotor pump of FIGS. 1–3.
Figure 10:
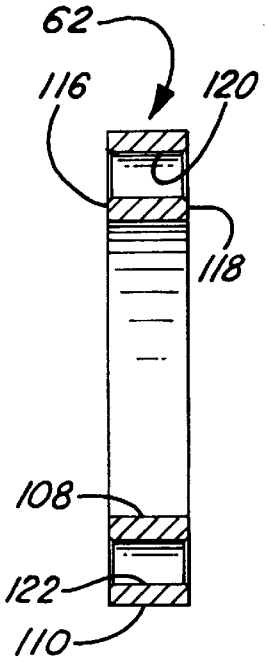
FIG. 10 is a cross-sectional view taken on the line 10—10 of FIG. 9.

Cam ring 62 is shown in detail in FIGS. 9 and 10. Ring 62 has concentric cylindrical inner and outer surfaces 108 and 110 and diametrically opposite radially outwardly protruding mounting lugs 112 and 114. Preferably, cam ring 62 is made from a high density ferrous sintered powder metal alloy composition that is steam heat treated to harden and surface oxidize to impart high strength, hardness, corrosion resistance and wear resistance. The edges of cylindrical surfaces 108 and 110 are not chamfered in order to maximize the bearing area of these surfaces to thus minimize the side loading of the gerotor ring rotor 64 when operable therein. Preferably, cam ring surface 108 is finished to dimensional specification before such steam treatment.

Each of the lugs 112, 114 of the cam ring has a mounting and alignment throughbore 120 and 122 respectively with the hole centers precisely located relative to the axial center of cam ring 62, their axes parallel to the cam ring axis and their diameters dimensioned to receive pin alignment portion 102 coaxially therethrough with a precision fit (e.g., a hole diameter of 3.426 mm with a tolerance of 0/+0.025 mm).

Figure 11:
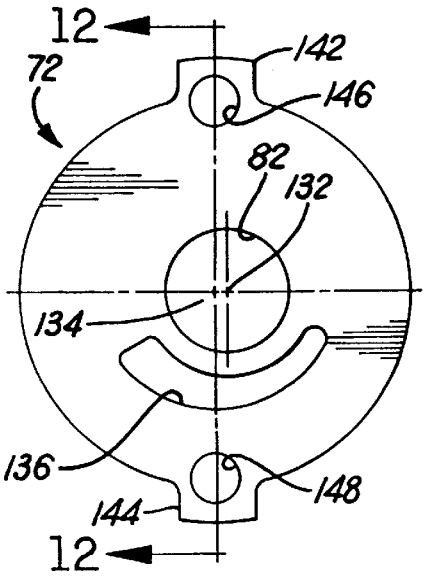
FIG. 11 is a top plan view of the outlet port plate of the pump of FIGS. 1–3.
Figure 12:
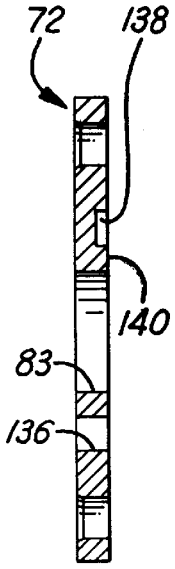
FIG. 12 is a cross-sectional view taken on the line 12—12 of FIG. 11.
Figure 13:
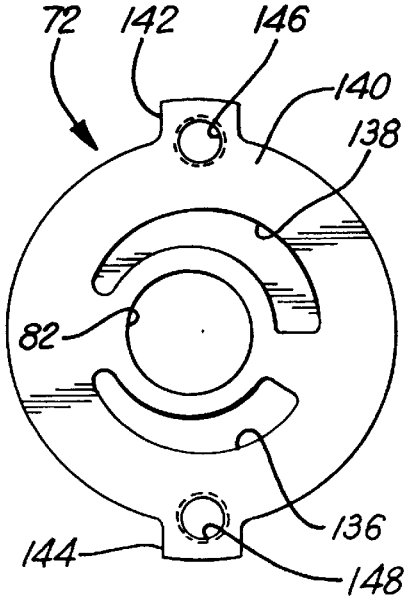
FIG. 13 is a bottom plan view of the outlet port plate of FIGS. 11 and 12.

The outlet port plate 72 of pump assembly 22 as shown in detail in FIGS. 11, 12 and 13. Port plate 72 has a cylindrical center hole 82 dimensioned to loosely receive the outer cylindrical periphery of the drive element 130 of rotor 26 (FIG. 1) during assembly of unit 20 as the same is journalled for rotation on the upper end of stub shaft 76 of pump assembly 22. As shown in FIGS. 11 and 13, the center 132 of hole 82 is off-set from the center 134 of plate 72 to accommodate the predetermined eccentricity of inner gear rotor 68 to outer gear rotor 64 in accordance with conventional gerotor pump construction and operation. Likewise outlet plate 72 has the usual arcuate outlet through-port 136 located therein as shown in FIGS. 11–13. A shallow depth arcuate groove 138 is formed in the bottom face 140 of port plate 72 to thereby define a conventional pressure balancing "shadow port". Port plate 72 also has a pair of radially protruding, diametrically opposite mounting ears 142 and 144, and mounting and alignment throughbores 146 and 148 located for coaxial alignment in assembly with cam ring holes 120 and 122 respectively (FIGS. 2 and 3), and made to the same diameter, tolerances and parallelism. Preferably port plate 72 is also made of sintered metal in the foregoing manner of cam ring 62 and with all the specification dimensions applied after steam treatment.

Figure 14:
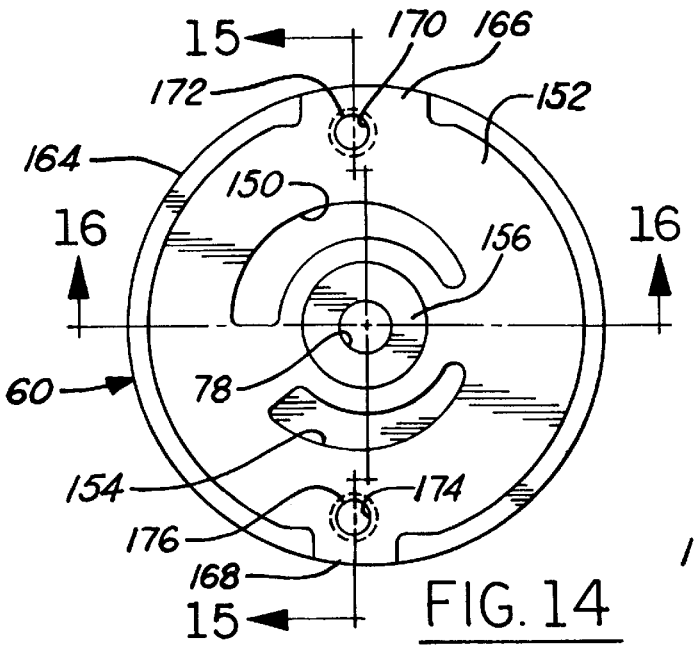
FIG. 14 is a top plan view of the inlet cap of the pump of FIGS. 1–3.
Figure 15:
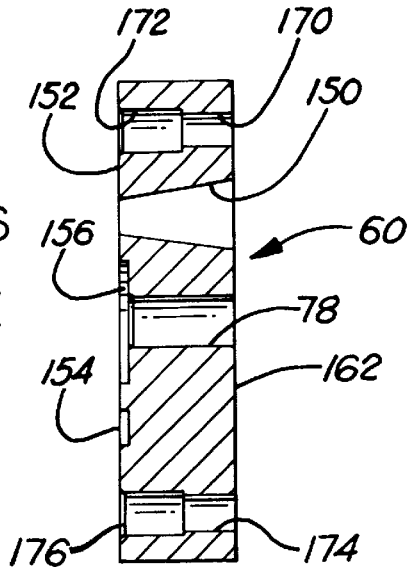
FIGS. 15 and 16 are cross-sectional views taken respectively on the lines 15—15 and 16—16 of FIG. 14.
Figure 16:
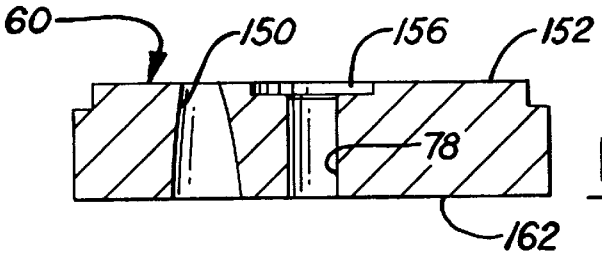
Figure 17:
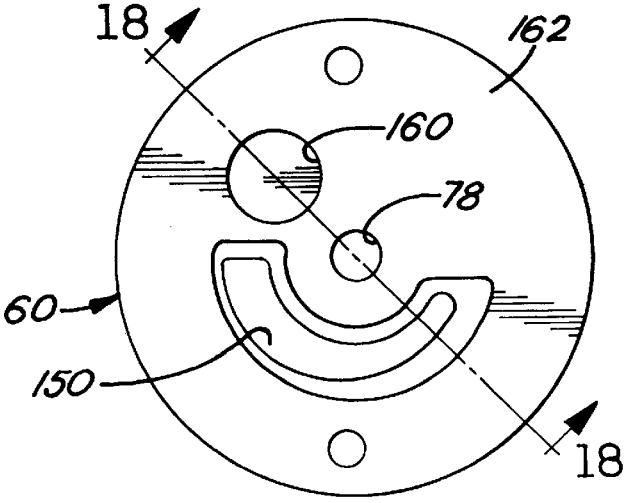
FIG. 17 is a bottom plan view of the inlet cap.
Figure 18:
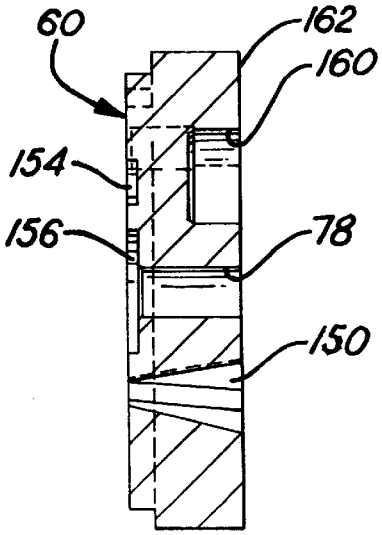
FIG. 18 is a cross sectional view taken on the line 18—18 of FIG. 17.

The details of the inlet port cap/cover plate 60 are shown in FIGS. 14–18. Plate 60 is also made of sintered powdered metal and steam treated and finished in the manner of plate 72. Plate 60 has the usual arcuate inlet through-port 150 located and configured therethrough as shown in FIGS. 14-18. The flat upper face 152 of plate 60 has a conventional "shadow port" 154 formed therein as shown in FIGS. 14, 15 and 18, as well as an annular recess 156 concentrically surrounding center hole 78. A cylindrical blind hole 160 is provided in the bottom face 162 of inlet plate 60 in order to provide in manufacturing a means for alignment in currently used production assembly fixtures. Upper face 152 is radially inset from the outer cylindrical periphery 164 of plate 60 except for diametrically opposed mounting ear portions 166 and 168 which in assembly align with the ears of cam ring 62 and port plate 72.

In accordance with the aforementioned combined fastening and alignment function of screw pins 74 and 75, inlet cover plate 60 is provided with a pair of diametrically opposite through-holes 170–172 and 174–176 in each of the mounting ear zones. Hole 170–172 comprises an internally threaded bore 170 opening at its lower end into plate bottom face 162 and at its upper end into a smooth cylindrical counterbore 172 in turn opening into plate upper face 152. The diametrically opposite ear zone 168 is likewise provided with a threaded bore 174 opening up into a smooth cylindrical counterbore 176 that opens to top face 152. The axes of through-holes 170–172 and 174–176 are machined in accurate precision positions for accurate alignment of plate port 150 and center hole 78 by the corresponding alignment with holes 120, 146 and 122, 148 of cam ring 62 and port plate 72 respectively in assembly of the aforementioned gerotor and plate components of pump assembly 22. Preferably the axial lengths of alignment counterbores 172 and 176 is made at least twice the diametrical dimension of alignment shank portion 102 of pin 74, 75, and diametrically sized to again provide a precision sliding fit therebetween. The threaded bores 170 and 174 are diametrically sized to mate with the diametrical dimension of threaded portions 104 of pins 74, 75 and hence are reduced in diameter from bores 172 and 176.

However, in keeping with the dual function alignment and fastening feature of screw pins 74 and 75, the thread form tapped in bores 170 and 174 is a number 4-40 UNC-2B thread using a tap oversized by +0.005 inches. By so forming the internal threads diametrically oversized in bores 170 and 174, sufficient radial play is introduced between the male threads 104 of pins 74 and 75 and their cooperative female threads in bores 174 and 170 respectively such that the precise axial and radial alignment of inlet cover 60, cam ring 62 and outlet port plate 72, as produced by the precision fit of alignment shank portion 102 therein in assembly, is not distorted or shifted by the stresses produced during threaded engagement of screw threads 104 with the internal threads in bores 170, 174. Nevertheless, sufficient thread interengagement remains radially thereof to ensure that sufficient clamping force is developed upon screwing down of pins 74 and 75 in assembly to thereby tightly clamp inlet and outlet plates 60 and 72 against the axially opposite flat faces of cam ring 62.

In manufacture, assembly and use of pump assembly 22 as a unitary operable gerotor subassembly, it thus will be seen that the alignment pin portions 102 of the two locator screws 74 and 75 and the bores 172 and 176 in the screw through-holes in port plate 72, the mounting holes in cam ring 62 and inlet cover plate 60, the stationary stub shaft 76 and its journal mounting in hole 80 in inner "star" rotor 68, and the press-fit of stub shaft 76 in mounting hole 78 in inlet cover plate 60, are all made to precision tolerances as to dimensions and location. Locator screws 74 and 75 thus function during and in assembly to provide proper radial and axial alignment and angular orientation of the plate ports and gear rotors to thereby accurately set the eccentric and angular relationship of these pump parts in assembly and operation, and with reference to the stationary center pin 76 on which the star rotor 68 is journalled. The loose tolerance threadable interengagement of screws pins 74,75 with these parts will not affect or alter the guide pin alignment function of the smooth shank of the locator screws. By so combining the orienting pin and fastening bolt functions into just two locator screws 74 and 75, the prior need for two to four separate fastening bolts and two additional orienting pins is eliminated, thereby significantly reducing the number of pump components. In addition, no setting or final adjustment of the components in assembly is necessary inasmuch as this is achieved merely by assembly and tightening down of screws 74 and 75 in assembled relation with the pump assembly components as shown in FIGS. 2 and 3.

An ancillary feature, the elongated screw heads 94 of each locator screw 74, 75 when made the predetermined length C provides in assembly with the components of motor 24 in pump housing 28 a very small axial clearance between their upper end faces 100 and the juxtaposed lower edges of permanent magnets 32. Hence, locator screws 74, 75 also serve as fail-safe stops to limit or prevent movement of the two motor permanent magnet segments 32 and 34 should the same become shaken loose from their retaining clips in the motor assembly. Such loosening can occur in rare instances when the fuel pump 20 is in-tank mounted and subjected to severe shaking and vibration forces generated by aggravated bouncing motion of a motor vehicle or water craft in which the pump and associated internal combustion engine are installed.

Due to the aforementioned radial and axial internal pump part clearances there is a potential internal short circuit or leakage path from the high pressure to low pressure side of the gerotor pump parts between faces 140 and 152 and the mutually adjacent faces of rotors 64 and 68 which produces a thin film of the liquid being pumped to thereby provide a hydro-dynamic anti-friction liquid bearing between these relatively moving parts. However, the thickness of this liquid film bearing is small enough so that it effectively serves as a liquid seal to limit such short circuiting to only a small percentage of pump output flow rate.

The hydro-dynamic anti-friction liquid bearing thereby obtained during such conventional gerotor pump operation prevents direct contact and wear of the outer rotor 64 against the inner surface 108 of cam ring 62 despite the high pressure side (radial) thrust forces encountered during normal operation of a gerotor pump. The liquid seal barrier also prevents excessive wear from minute contaminant particles admitted through filter 46 and thus entrained in the fuel circulating through the pump. Even with uncontaminated fuel, frictional drag is also reduced as compared to zero clearance gerotor pumps having relatively moving pump part surfaces in direct sliding contact. End face wear and frictional drag of inner and outer rotors 68 and 64 thus is also reduced or eliminated relative to the axially flanking faces 140 and 152 of port plate 72 and inlet cap 60.

Due to these features the pump can operate at higher output pressure, i.e., 90 psi versus 30–60 psi normally encountered in most automotive applications, while also pumping "dry gasoline" (i.e., gasoline such as winter fuel having very low lubricity) and/or containing a high degree of particulate contamination without experiencing excessive wear. As a consequence pump 20 provides improved boundary lubrication, reduced drag and reduced contamination sensitivity, resulting in increased pump efficiency, reliability and service life.

As also indicated previously, the axial dimensions of star rotor 68 and outer rotor 64 are made slightly less then the axial spacing of the axially opposite faces 116 and 118 of the cam ring 62 to set up a predetermined fixed face or axial clearance between these gerotor parts and their flanking outlet port plate 72 and inlet port cap 60. Hence, these gerotor parts 64 and 68 can float axially between these two boundary plates within this fixed axial clearance. Preferably this axial clearance is in the order of 0.0005"–0.0030" total face clearance, (i.e., 0.00025"–0.0015" axial clearance per side). In addition, the radial clearance between cam ring 62 and rotor 64 is in the range of 0.0015" to 0.0050".

Preferably, in the exemplarily but preferred embodiment disclosed herein, rotor 68 and rotor 64 are also made as sintered powdered metal components steam treated and finished with an eight tooth inner star 68 and a nine tooth ring gear 64. These gerotor rotors preferably have no chamfers in order to maximize the bearing area and thus produce the thickest hydro-dynamic film possible. The axial dimensions of the rotors 64 and 68 as well as that of cam ring 62 are machined to tolerances of plus or minus 0.003 mm to establish the desired axial clearance. Preferably, inlet port 150 in inlet cover plate 60 is contoured as shown in FIGS. 14–18 to reduce the pressure drop therethrough. Preferably the end of intake port 150 is advanced 20° to increase the time for the gerotor to fill for enhanced hot fuel performance. The shadow port 154 in inlet cover plate 60 is provided to help balance the gerotor relative to the exhaust port 136 and outlet port plate 72, and likewise as to shadow port 138 in port plate 72 relative to inlet port 150, thus promoting the formation of a hydrodynamic film. Preferably, the fastener/alignment pin screws 74 and 75 are made from steel to facilitate interference engagement of shank portion 102 in cover plate bores 172 and 176 during assembling of pump assembly 22 as described previously. Preferably, the outer diameter of drive dog 130 is reduced relative to the diameter of opening 82 in outlet port plate 72 to improve the face liquid flow across the inlet and outlet port plates 60 and 72.

In one working exemplary embodiment of a pump constructed in accordance with the foregoing description and drawings, the following design and operational parameters were observed:

Maximum radial clearance between gerotor outer ring 64 and surface 108 of cam ring 62 . . . 0.0050"

Maximum axial clearance between gerotor components 64, 68 and bottom face 140 of port plate 72 in assembly . . . 0.0030"

Compression angle between the end of inlet port 150 to the beginning of exhaust port 136, minus the transition angle of 40°(360°/9 teeth) . . . −5° to +10°

Armature timing angle of the motor commutator to the motor laminations using a carbon commutator . . . 3°

We claim:

1. A fuel pump including a pump unit suitable for feeding a liquid including fuel and being operative with a drive motor coupled to the pump unit and wherein the pump unit comprises an inlet cover plate, an outlet port plate, an intermediate cam ring sandwiched between the inlet cover plate and the outlet port plate, a gerotor set having an outer rotor with internal teeth and an inner rotor with external teeth and disposed eccentric to the outer rotor, the inner rotor being drivable in rotation by the motor and comprising a lesser number of teeth than the number of teeth of the outer rotor and a portion of the teeth of the inner rotor meshed with the internal teeth of the outer rotor, said cam ring having a circular shaped recess for receiving and bearing the outer rotor, and an inlet opening and an outlet opening disposed respectively in the inlet cover plate and in the outlet port plate; the improvement in combination therewith of first and second alignment and fastening screw pins for clamping said plates and cam ring in sandwiched relationship, each said fastener pin comprising a cylindrical smooth surface shank portion merging at one end with a radial enlarged head portion and at the other end with a threaded cylindrical portion having external threads, each of said plates and said cam ring having first and second coaxial aligned through-holes each with a cylindrical smooth surface sized to closely receive said shank portion of the associated first and second fastening pins, and first and second threaded holes in said inlet cover plate coaxially aligned respectively with said first and second cylindrical smooth surface bore holes in said inlet cover plate and spaced thereby from said cam ring, said inlet cover plate threaded holes being of slightly reduced diameter relative to said inlet cover plate smooth surface bore holes and having internal threads for engagement respectively with the external threads of said threaded portion of said first and second fastening pins, and wherein the radial tolerances between said pin external threads and inlet cover hole internal threads are larger than the diametrical tolerances between said shank portion of said pins and the associated smooth surface alignment bores in said plates and cam ring.

2. The fuel pump of claim 1 wherein said head portions of said pins have a predetermined elongated axial dimension extending axially between said outlet port plate and said motor, and wherein said motor has permanent magnet means mounted as initially assembled in said pump with end portions mutually juxtaposed in close proximity to mutually adjacent end surfaces of said pin head portions whereby the latter are operative as fail-safe stops limiting loosening motion of said magnet means toward said pump unit.

3. The fuel pump of claim 1 wherein said motor and pump unit are encased as a unitary construction in a housing, said inlet cover plate having a stub shaft mounted therein on which said inner rotor is journalled, said pump unit rotors having predetermined fixed assembly axial and radial clearance dimensions relative to said plate and cam ring recess respectively and being established and maintained in assembly by the fitment said fastener pins in said plates and cam ring relative to said stub shaft.

4. The fuel pump of claim 3 wherein each said smooth cylindrical surface of each said through-hole in said inlet cover plate has a precision sliding fit with said cylindrical smooth surface shank portion of the associated said pin received therein in final assembly.

5. The fuel pump of claim 4 wherein each of said smooth cylindrical surfaces of said through-holes in said outlet port plate and said cam ring have a precision sliding fit with said cylindrical smooth surface shank portion of the associated said pin received therethrough in assembly.

6. The fuel pump of claim 5 wherein each head portion of said pins has a torque application configuration in an end face thereof disposed remote from said outlet port plate for rotatably threading the associated pin into threaded engagement with said inlet cover plate.

7. The fuel pump of claim 3 wherein said axial clearance dimension is in the order of 0.0005" to 0.0030" and said radial clearance dimension is in the order of 0.0015 to 0.0050".

8. The fuel pump of claim 1 wherein said pump unit is held together in properly oriented component relationship in final assembly as an operable gerotor pump solely by said screw pins.

9. An electric motor fuel pump that comprises:

an inlet end cap having a fuel inlet, an outlet end cap having a fuel outlet and a case coaxially joining said end caps to form a pump housing, an electric motor including an armature journalled for rotation between said end caps within said housing, a stator including spring-retained permanent field magnets surrounding said armature and means for applying electrical power to said motor, and means coupled to said armature for pumping fuel from said inlet to said outlet through said housing such that fuel within said housing is at generally outlet pressure, said pumping means comprising:

an inlet port plate, an outlet port plate and a cam ring sandwiched between said plates and forming a gerotor pocket axially between said plates, inner and outer gear rotors disposed in said pocket, said rotors having radially opposed intermeshing teeth that define circumferentially disposed expanding and contracting pumping chambers, said cam ring having an inner wall defining said pocket and being radially spaced from said outer gear rotor by a radial gap, passageway means on said inlet and outlet plates respectively forming inlet and outlet ports axially opening to gear spaces between said rotors and into said expanding and contracting chambers respectively, drive means coupling said armature to said inner gear rotor to drive said pump, and fastening means clamping said plates and cam ring in tightly sandwiched relationship, said fastening means having axially elongated heads closely juxtaposed to mutually facing edges of said permanent magnets to serve as fail-safe stops limiting loosening motion of said magnets from an internally assembled spring-retained position in said pump housing.

10. The fuel pump of claim 9 wherein said fastening means comprises first and second alignment and fastening screw pins and first and second cylindrical smooth surface bore holes in said inlet cover plate and spaced thereby from said cam ring, said inlet cover plate threaded holes being of slightly reduced diameter relative to said inlet cover plate smooth surface bore holes and having internal threads for engagement respectively with the external threads of said threaded portion of said first and second fastening pins, and wherein the radial tolerances between said pin external threads and inlet cover hole internal threads are larger than the diametrical tolerances between said shank portion of said pins and the associated smooth surface alignment bores in said plates and cam ring.

11. The fuel pump of claim 10 wherein said pump unit is held together in properly oriented component relationship in final assembly as an operable gerotor pump solely by said screw pins.

12. The fuel pump of claim 11 wherein said inlet end cap has a fuel inlet passageway communicating with said inlet plate inlet port and a fuel filter operably mounted upstream of said inlet port, said inlet port plate having a stub shaft precision mounted therein on which said inner rotor is journalled, said pump rotors having a predetermined fixed assembly axial and radial clearance dimensions relative to said plate and cam ring recess respectively and being established and maintained in assembly by said fastener pins in said plates and cam ring relative to said stub shaft.

13. The fuel pump of claim 12 wherein said axial clearance dimension is in the order of 0.0005" to 0.0030" and said radial clearance dimension is in the order of 0.0015" to 0.0050".

14. The fuel pump of claim 13 wherein each head portion of said pins has a torque application configuration in an end face thereof disposed remote from said outlet port plate for rotatably threading the associated pin into threaded engagement with said inlet cover plate.

15. The fuel pump of claim 14 wherein said plates, cam ring and rotors are made of high density powder ferrous metal alloy composition sintered and then steam heat treated and then finished to precision dimensions to establish said clearances in assembly with said screw pins and stub shaft.

16. A method of making an electric motor fuel pump that comprises the steps of:

(a) providing an inlet end cap having a fuel inlet, an outlet end cap having a fuel outlet and a case coaxially joining said end caps to form a pump housing, (b) providing an electric motor including an armature journalled for rotation between said end caps within said housing, a stator including spring-retained permanent field magnets surrounding said armature and means for applying electrical power to said motor, and (c) providing means coupled to said armature for pumping fuel from said inlet to said outlet through said housing such that fuel within said housing is at generally outlet pressure, said pumping means comprising:

(d) providing an inlet port plate, an outlet port plate and a cam ring sandwiched between said plates and forming a gerotor pocket axially between said plates, (e) providing inner and outer gear rotors disposed in said pocket, said rotors having radially opposed intermeshing teeth that define circumferentially disposed expanding and ensmalling pumping chambers, said cam ring having an inner wall defining said pocket and being radially spaced from said outer gear rotor by a radial gap, (f) providing passageway means on said inlet and outlet plates respectively forming inlet and outlet ports axially opening to gear spaces between said rotors and into said expanding and ensmalling chambers respectively, (g) providing drive means coupling said armature to said inner gear rotor to drive said pump, and (h) clamping said plates and cam ring in tightly sandwiched relationship by fastening means having axially elongated heads closely juxtaposed to mutually facing edges of said permanent magnets to serve as fail-safe stops limiting loosening motion of said magnets from an internally assembled spring-retained position in said pump housing.

17. The method of claim 16 wherein said fastening means are provided as first and second alignment and fastening screw pins and first and second cylindrical smooth surface bore holes in said inlet cover plate and spaced thereby from said cam ring, forming the inlet cover plate threaded holes of slightly reduced diameter relative to that of the inlet cover plate smooth surface bore holes and providing therein internal threads for engagement respectively with the external threads of said threaded portion of said first and second fastening pins, and forming the radial tolerances between said pin external threads and inlet cover hole internal threads larger than the diametrical tolerances between said shank portion of said pins and the associated smooth surface alignment bores in said plates and cam ring.

* * * * *

UNITED STATES PATENT AND TRADEMARK OFFICE

CERTIFICATE OF CORRECTION

PATENT NO. : 5,997,262

DATED : December 7, 1999

INVENTOR(S) : Steven P. Finkbeiner, Kirk D. Fournier
George E. Maroney and Glenn A. Moss It is certified that error appears in the above-indentified patent and that said Letters Patent is hereby corrected as shown below:

Col 10, Line 64, delete "fitment" and insert -- fit of --.

Col 12, Line 21, after "by" insert -- the fit of --.

Col 12, Line 58, delete "ensmalling" and insert -- contracting --.

Signed and Sealed this

Ninth Day of January, 2001

*Attest:*

Q. TODD DICKINSON

*Attesting Officer*

*Commissioner of Patents and Trademarks*